United States Patent [19]

Nakamura et al.

[11] Patent Number: 4,517,134

[45] Date of Patent: May 14, 1985

[54] VARIABLE VENTURI CARBURETOR

[75] Inventors: Ken Nakamura, Kawasaki; Tadashi Nagai, Yokosuka; Giichi Shioyama, Yokosuka; Yutaka Matayoshi, Yokosuka; Eiichi Ohnishi, Yokosuka; Junichi Yokoyama, Ebina; Atsushi Yonezawa, Yokosuka, all of Japan

[73] Assignee: Nissan Motor Company, Ltd., Japan

[21] Appl. No.: 560,973

[22] Filed: Dec. 13, 1983

[30] Foreign Application Priority Data

| | | | |
|---|---|---|---|
| Dec. 27, 1982 | [JP] | Japan | 57-234714 |
| Mar. 15, 1983 | [JP] | Japan | 58-37111[U] |
| Mar. 17, 1983 | [JP] | Japan | 58-38812[U] |

[51] Int. Cl.[3] ..... F02M 9/06

[52] U.S. Cl. ..... 261/39 A; 261/44 C; 261/69 R; 261/DIG. 74; 123/439

[58] Field of Search ..... 123/439; 261/44 C, 69 R, 261/39 A, DIG. 74

[56] References Cited

U.S. PATENT DOCUMENTS

| | | | |
|---|---|---|---|
| 3,243,167 | 3/1966 | Winkler | 261/44 C |
| 3,765,658 | 10/1973 | Hartel et al. | 261/44 C |
| 3,911,884 | 10/1975 | Moriya et al. | 261/44 C |
| 4,044,080 | 8/1977 | Matsumoto et al. | 261/44 B |
| 4,411,233 | 10/1983 | Chenet et al. | 123/439 |

FOREIGN PATENT DOCUMENTS

| | | | |
|---|---|---|---|
| 2550089 | 5/1976 | Fed. Rep. of Germany . | |
| 2625978 | 12/1976 | Fed. Rep. of Germany | 261/44 C |
| 2644613 | 12/1977 | Fed. Rep. of Germany . | |
| 3139751 | 4/1982 | Fed. Rep. of Germany . | |
| 48-25120 | 3/1973 | Japan . | |
| 50-33338 | 3/1975 | Japan . | |
| 50-35541 | 4/1975 | Japan . | |
| 50-66618 | 6/1975 | Japan . | |
| 50-10043 | 8/1975 | Japan . | |
| 54-13202 | 10/1979 | Japan . | |
| 429620 | 6/1935 | United Kingdom | 261/44 C |
| 1144405 | 3/1969 | United Kingdom | 261/44 C |
| 1445849 | 8/1976 | United Kingdom . | |

*Primary Examiner*—Tim Miles

*Attorney, Agent, or Firm*—Leydig, Voit, Osann, Mayer and Holt, Ltd.

[57] ABSTRACT

In a variable venturi carburetor in which the metering jet portion of fuel changes automatically according to the amount of intake air required to keep the mixture at a constant air-to-fuel ratio at all times, two series-arranged nozzles and an auxiliary fuel passage communicating with the downstream side of the venturi and with the space formed between the two nozzles additionally formed at the fixed venturi portion in such a way that the auxiliary fuel passage can be opened or closed according to engine operating conditions. Therefore, when the auxiliary fuel passage is opened, since fuel is introduced into the venturi through only a single nozzle, a rich mixture is obtained; when the auxiliary fuel passage is closed, since fuel is introduced through two nozzles, a lean mixture is obtained.

13 Claims, 22 Drawing Figures

VARIABLE VENTURI CARBURETOR

BACKGROUND OF THE INVENTION

1. Field of the Invention

The present invention relates generally to a variable venturi carburetor for an engine in which the cross-sectional area of a venturi portion automatically changes according to the amount of intake air to keep the vacuum generated at the venturi portion at a constant level, regardless of the amount of intake air, the carburetor of this type being called a constant vacuum carburetor. Further, in a carburetor of this type, the metering jet portion of fuel also automatically changes according to the amount of intake air to supply a mixture of a predetermined air-to-fuel ratio. The present invention relates specifically to a variable venturi carburetor of constant vacuum type in which the air-to-fuel ratio can be controlled according to engine operating conditions.

2. Description of the Prior Art

Variable venturi carburetors or constant vacuum carburetors are well known. The variable venturi carburetor is usually attached to an intake passage on the upstream side from a throttle valve. The venturi portion thereof is formed between a fixed venturi portion and a movable venturi portion. The fixed venturi portion includes a nozzle body having a nozzle portion at one end thereof, the nozzle body being connected to a float chamber to supply fuel from the float chamber to the intake passage. The movable venturi portion includes a suction cylinder, a suction piston the inner space of which is partitioned into an atmospheric pressure chamber and a vacuum chamber, and a suction spring.

The suction piston serving as the movable venturi portion moves toward or away from the fixed venturi portion, in dependence upon the force balance determined by pressure difference between the atmospheric pressure chamber and vacuum chamber, the urging force of the suction spring, and the weight of the suction piston, so that the cross-sectional area of the venturi portion changes according to the amount of intake air to keep vacuum at a constant level at the venturi portion. Further, at the center of the lower end surface of the suction piston, a tapered jet needle is fixed so as to pass through a central hole formed in the nozzle body. Therefore, when the suction piston moves toward or away from the fixed venturi portion, the metering jet portion formed between the jet needle and the nozzle portion of the nozzle body varies to keep the mixture obtained at the venturi portion at a predetermined air-to-fuel ratio.

In the prior-art variable venturi carburetor thus constructed, since the stroke of the suction piston is determined according to the amount of intake air and therefore the area of the metering jet portion between the tapered jet needle and the nozzle body is also determined according to the stroke of the suction piston, the air-to-fuel ratio is roughly kept at a constant level, even when the amount of intake air changes. Therefore, there exists a problem in that is impossible to supply a mixture of an appropriate air-to-fuel ratio into the engine according to various engine operating conditions. In more detail, when an engine is running at a low speed and under a heavy load, a rich mixture is preferable for increasing engine power; on the other hand, when an engine is running at a high or medium speed and under a light load, a lean mixture is preferable for saving fuel. However, in the prior-art variable venturi carburetor, since the air-to-fuel ratio is adjusted at a constant level at all times, it is impossible to vary the air-to-fuel ratio freely according to various engine operating conditions.

A more detailed description of the prior-art variable venturi carburetor will be made with reference to the attached drawings under DETAILED DESCRIPTION OF THE PREFERRED EMBODIMENTS.

SUMMARY OF THE INVENTION

With these problems in mind, therefore, it is the primary object of the present invention to provide a variable venturi carburetor in which the amount of fuel jetted into the variable venturi portion, that is, the air-to-fuel ratio can be adjusted according to engine operating conditions. In more detail, a rich mixture can be supplied to an engine to increase engine power when the engine is running at a low speed and under a heavy load, and a lean mixture can be supplied to an engine to save fuel when the engine is running at a high speed and under a light load.

To achieve the above-mentioned object, the variable venturi carburetor according to the present invention comprises a fixed venturi portion; a nozzle body having at least two nozzle portions arranged in series within the nozzle body disposed in the fixed venturi portion; a suction piston serving as a movable venturi portion for forming a venturi between the fixed venturi portion and the movable venturi portion within an intake passage; a tapered jet needle fixedly or pivotably attached to the lower end of the suction piston so as to pass through the nozzle portions formed in the nozzle body; an auxiliary fuel passage, one end of which communicates with the intake passage at a downstream region of the venturi and the other end of wh ich communicates with a space formed between the two nozzle portions; and means for controlling the cross-sectional area of the auxiliary fuel passage according to engine operating conditions. In the variable venturi carburetor according to the present invention, a greater amount of fuel is jetted into the intake passage through at least a single nozzle portion when the auxiliary fuel passage is opened and a smaller amount of fuel is jetted into the venturi in the intake passage through at least two nozzle portions when the auxiliary fuel passage is closed, according to engine operating conditions, respectively. The engine operating conditions are vacuum generated within the intake passage, coolant temperature, engine speed, etc.

BRIEF DESCRIPTION OF THE DRAWINGS

The features and advantages of the variable venturi carburetor according to the present invention over the prior-art variable venturi carburetor will be more clearly appreciated from the following description of the preferred embodiments of the invention taken in conjunction with the accompanying drawings in which like reference numerals designate the same or similar elements or sections throughout the figures thereof and in which:

FIG. 12(*b*) is a similar graphical representation showing a control signal of a smaller duty cycle outputted from the controller shown in FIG. 11.

DETAILED DESCRIPTION OF THE PREFERRED EMBODIMENTS

Generally, a variable venturi carburetor is called a constant vacuum carburetor in which the cross-sectional area of venturi is automatically adjusted according to the amount of intake air in order to maintain the vacuum generated at the venturi portion at a constant level, and further the metering jet area formed between a jet needle body and a nozzle is also automatically adjusted according to the variation in venturi cross-sectional area in order to supply the mixture of a predetermined air-to-fuel ratio to the engine.

To facilitate understanding of the present invention, a reference will be made hereinbelow to a prior-art variable venturi carburetor for an engine, with reference to the attached drawings.

Figure 1:
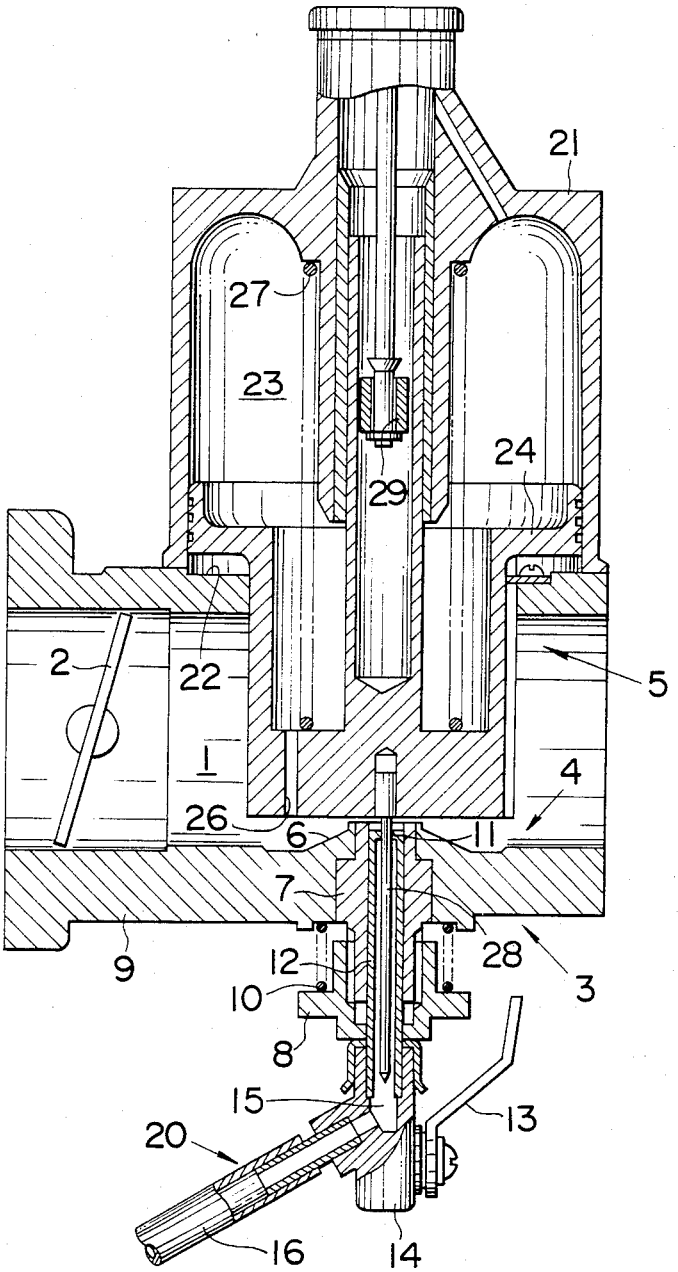
FIG.1 (PRIOR ART)
FIG. 1 is a cross-sectional front view showing an example of prior-art variable venturi carburetors for engines.
Figure 2:
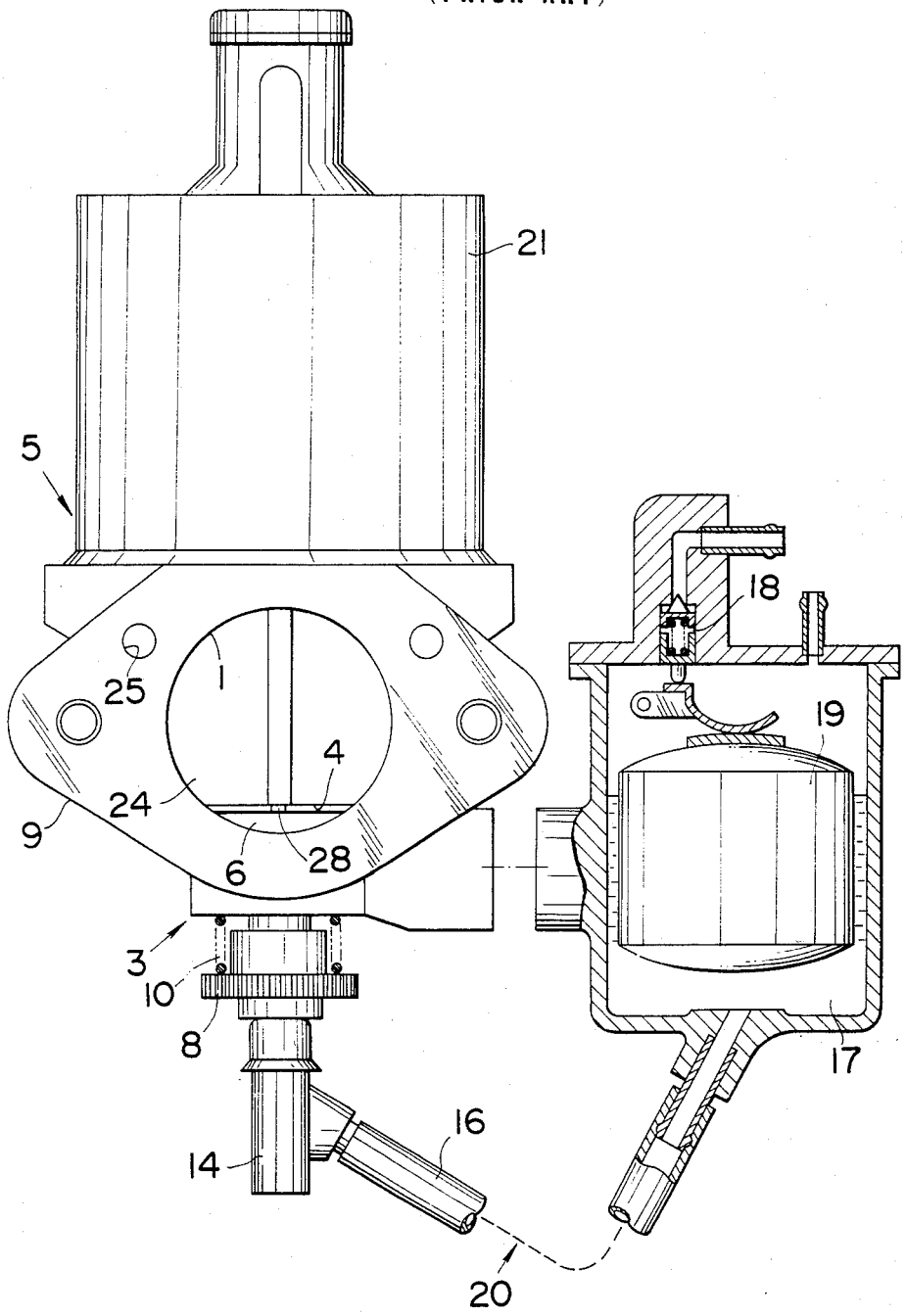
FIG. 2 (PRIOR ART)
FIG. 2 is a side view showing the prior-art variable venturi carburetor for an engine shown in FIG. 1, including a cross-sectional view showing a float chamber.

FIGS. 1 and 2 show an example of prior-art variable venturi carburetors, which is described in a book titled "Carburetors" by Takashi Yoshida, published from TETSUDO NIPPON-SHA. In the drawings, the variable venturi carburetor is attached to an intake passage 1 on the upstream side from a throttle valve 2 mechanically connected to an accelerator pedal (not shown). The venturi portion 4 is formed between a fixed venturi portion 3 and a movable venturi portion 5. The fixed venturi portion 3 includes a projection 6 projecting inwardly from the inner wall of the intake passage 1 and extending in a flat configuration or state when seen through the intake passage 1, as depicted in FIG. 2. A nozzle guide 7 is fitted to a hole formed at the center of this projection 6. To the end portion of the nozzle guide 7, an idle adjusting nut 8 is screw-fitted. A spring 10 is disposed in compression mode between the idle adjust nut 8 and an intake pipe 9. Into the nozzle guide 7, a nozzle body 12 having a nozzle portion 11 at one end portion thereof is slidably inserted. To the other end portion of the nozzle body 12, a connector 14 having a lever 13 is screw-fitted. When this lever 13 is moved automatically or manually at engine start, the nozzle body 12 is moved in the downward direction to increase the metering jet area formed at the nozzle portion 11. Further, this connector 14 is urged in the upward direction by a spring (not shown). Within the nozzle body 12, a fuel passage 15 is formed communicating with the nozzle portion 11.

With reference to FIG. 2, therefore, fuel is supplied from a float chamber 17 to the intake passage 1 via a fuel pipe 16. On the other hand, fuel is supplied from a fuel tank (not shown) to the float chamber 17 via a needle valve 18. A float 19 is moved up and down according to the amount of fuel within the float chamber 17 in order to open or close the needle valve 18, so that the amount of fuel within the float chamber 17 is always kept at a constant level. The reference numeral 20 denotes a fuel passage from the float chamber 17 to the nozzle body 12.

With reference to FIG. 1 again, the movable venturi portion 5 is made up of a suction cylinder 21 disposed on the opposite side of the fixed venturi portion 3 and a suction piston 24 slidably fitted to the suction cylinder 21 so as to partition the inside of the suction cylinder 21 into an atmospheric pressure chamber 22 and a vacuum chamber 23. Further, the venturi portion 4 is formed between the bottom surface of the suction piston 24 (the movable venturi portion 5) and the fixed venturi portion 3. Atmospheric pressure is introduced into the atmospheric pressure chamber 22 through atmosphere holes 25 (shown in FIG. 2) and venturi vacuum on the downstream side from the venturi portion 4 is introduced into the vacuum chamber 23 through a suction hole 26 formed in the suction piston 24 (shown in FIG. 1). The suction piston 24 is urged toward the fixed venturi portion 3 by a suction spring 27 disposed in compression mode within the vacuum chamber 23. As a result, the suction piston 24 moves toward or away from the fixed venturi portion 3 in dependence upon the force balance determined by the difference in pressure between the atmospheric pressure chamber 22 and the vacuum chamber 23, the urging force of the suction spring 27 and the weight of the suction piston 24 itself. At the center of the bottom end of this suction piston 24, a tapered jet needle 28 is fixed passing through the nozzle portion 11 formed at the top end of the needle body 12. Therefore, an annular metering jet portion is formed between the tapered jet needle 28 and the nozzle portion 11 of the nozzle body 12. The area of this annular metering jet portion increases when the suction piston 24 moves upwards away from the fixed venturi portion 3 and decreases when the suction piston 24 moves downward toward the fixed venturi portion 3. Further, the reference numeral 29 shown in FIG. 1 denotes an oil damper for preventing the suction piston 24 from being vibrated due to pulsation of intake pressure.

In the variable venturi carburetor as described above, the suction piston 24 is moved toward or away from the fixed venturi portion 3 in dependence upon the vacuum generated at the venturi portion 4, that is, the amount of intake air. As a result, the area of the metering jet portion varies according to the stroke of the suction piston 24. In more detail, when the throttle valve 2 is fully opened, the amount of intake air increases, so that a high vacuum is generated at the venturi portion 4. As a result, this vacuum is introduced into the vacuum chamber 23 through the suction hole 26 to the upper side of the suction piston 24, so that the suction piston 24 is moved upward away from the fixed venturi portion 3 to increase the cross-sectional area of the venturi portion 4. Therefore, the area of the annular metering jet portion increases, so that a greater amount of fuel corresponding to the greater amount of intake air is jetted into the intake passage 1 through the metering jet portion.

On the other hand, when the throttle valve 2 is opened a little, since the amount of intake air is small, the vacuum generated at the venturi portion 4 is not high. Therefore, the suction piston 24 is moved in the downward direction to decrease the cross-sectional area of the venturi portion 4. Therefore, the area of the annular metering jet portion decreases, so that a smaller amount of fuel corresponding to the smaller amount of intake air is jetted into the intake passage 1 through the metering jet portion. As the variable venturi carburetor is called a constant vacuum carburetor, the vacuum or the air flow rate at the venturi portion 4 is always kept roughly at a predetermined level regardless of the amount of intake air. This is because the cross-sectional area of venturi portion varies roughly in proportion to the amount of intake air. Additionally, the air-to-fuel ratio is always kept at a constant level regardless of the amount of intake air. This is because the area of the metering jet portion varies roughly in proportion to the amount of intake air.

In the prior-art variable venturi carburetor as described above, however, since the structure is such that the stroke of the suction piston is determined according to the amount of intake air and therefore the area of the metering jet portion (between the tapered jet needle and nozzle) is also determined according to the stroke of the suction piston, the air-to-fuel ratio is fixedly determined according to the amount of intake air. Therefore, there exists a problem in that is impossible to supply a mixture of an appropriate air-to-fuel ratio into the engine according to various engine operating conditions under which various air-to-fuel ratios are required even if the amount of intake air is constant. In more detail, when an engine is driven at a low speed and under a heavy load, a rich mixture is desired for increasing engine power. On the other hand, when an engine is driven at a high or medium speed and under a light load, a lean mixture is desired for saving fuel. However, in the prior-art variable venturi carburetor, as apparent from the above description, it is impossible to vary the air-to-fuel ratio according to various engine operating conditions.

In view of the above description, reference is now made to the embodiments of the variable venturi carburetor according to the present invention. The feature of the present invention is to change the fuel jetted into the intake passage, that is, air-to-fuel ratio according to engine operating conditions such as engine speed, coolant temperature, etc.

Figure 3:
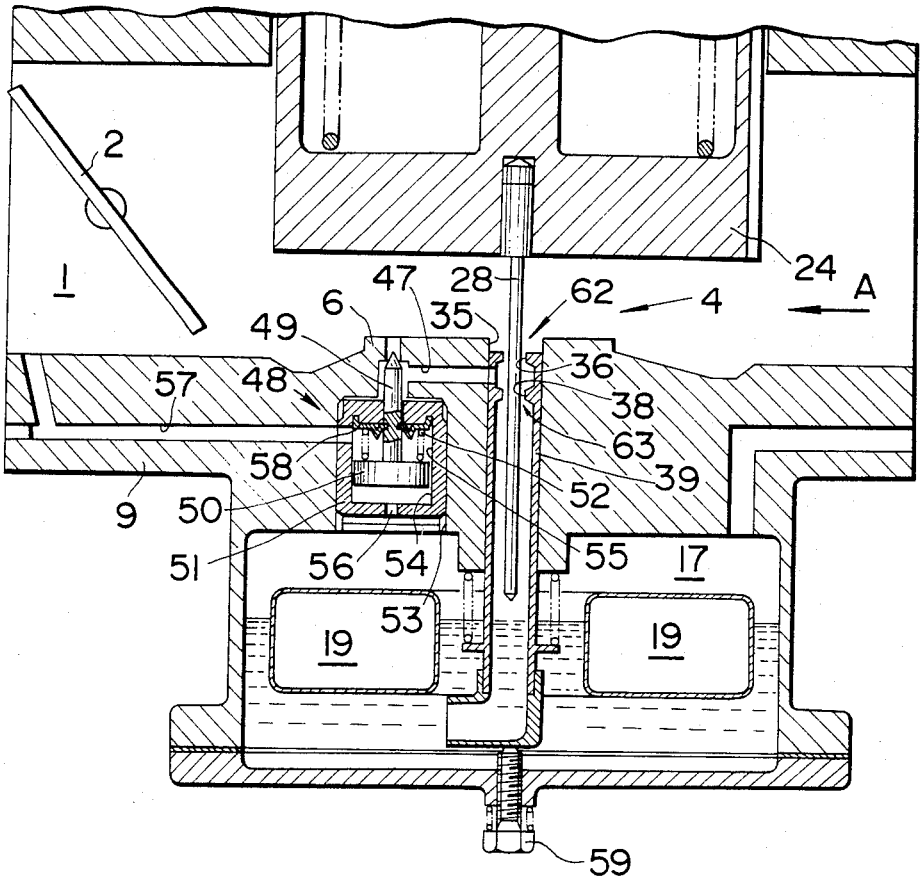
FIG. 3 is an enlarged cross-sectional view of a first embodiment of the variable venturi carburetor according to the present invention showing the fixed venturi portion including two series-arranged nozzle portions, an auxiliary fuel passage, and a vacuum valve, in which a float chamber is incorporated under the fixed venturi portion.

FIG. 3 is an enlarged cross-sectional view showing a first embodiment of the variable venturi carburetor according to the present invention, in which the float chamber is incorporated intergrally therewith. In this drawing, the arrow A indicates the direction that intake air flows within the intake pipe 9. The reference numeral 1 denotes an intake air passage formed within an intake pipe 9 communicating with an engine. Within the intake air passage, a throttle valve 2 linked to an accelerator pedal is disposed. On the upstream side from the throttle valve 2, a venturi portion 4 is formed between a fixed venturi portion 6 and a movable venturi portion 24. The fixed venturi portion 6 is a projection 6 projecting inwardly from the inner wall of the intake passage 1 and extending in flat state when seen through the intake pipe 9 in the same way as in the prior art carburetor shown in FIGS. 1 and 2. The movable venturi portion is the lower end surface of a suction piston 24. The cross-sectional area of the venturi portion 4 is varied when the movable venturi portion of the suction piston 24 moves toward or away from the fixed venturi portion 6 in dependence upon the vacuum generated at the venturi portion 4.

At the fixed venturi portion 6, a hole 35 is formed, into which a movable nozzle body 39 is slidably fitted. At the upper end portion of the nozzle body 39, there are formed a first nozzle 36 opening toward the fixed venturi portion 6 and a second nozzle 38 disposed under the first nozzle 36 in series with each other. This nozzle body 39 serves as a fuel passage for supplying fuel to these nozzle 36 and 38.

The lower end portion of the nozzle body 39 disposed under the fixed venturi portion 6 is positioned within a float chamber 17 to which fuel is supplied from a fuel tank (not shown). A float 19 moves up and down according to the amount of fuel within the float chamber 17 in order to control the fuel supplied to the float chamber 17. Therefore, the amount of fuel within the float chamber 17 is always kept at a constant level. As a result, the fuel level within the nozzle body 39 is kept at a constant level.

An auxiliary fuel passage 47 is formed in the fixed venturi portion 6, one end portion of which communicates with the intake air passage 1 at a position between the throttle valve 2 and the jet needle 28 and the other end portion of which communicates with the nozzle body 39 at a position between the first nozzle 36 and the second nozzle 38. In this auxiliary fuel passage 47, a control valve 48 is provided adjustably opening and closing this passage 47. The control valve 48 includes a valve body 49 with a valve piston 50, a valve housing 51 and a valve spring 52. The control valve 48 is fitted to a bore 53 formed in the inner wall of the intake pipe 9. The valve piston 52 is slidably fitted to the valve housing 51 and partitions the inside of the valve housing 51 into an atmospheric pressure chamber 54 and a vacuum chamber 55. Atmospheric pressure is introduced from the float chamber 17 into the atmospheric pressure chamber 54 through a hole 56 formed at the bottom of the valve housing 54. Vacuum generated on the downstream side from the throttle valve 2 is introduced into the vacuum chamber 55 through a vacuum passage 57 also formed in the wall of the intake pipe 9. The valve spring 52 is disposed within the valve housing 51 in such a way as to urge the valve piston 50 toward the atmospheric pressure chamber 54 (downward in FIG. 3). Further, the reference numeral 58 denotes a diaphragm disposed on the upper wall within the vacuum chamber 55 in order to prevent fuel from leaking from the intake passage 1 to the vacuum chamber 55 while the valve body 49 moves up and down.

Therefore, when the vacuum within the intake passage 1 exceeds a predetermined value, the valve body 49 of the control valve 48 moves together with the valve piston 50 in the upward direction against the urging force of the valve spring 52, so that the auxiliary fuel passage 47 is closed. On the other hand, when the vacuum within the intake passage 1 is below the predetermined value, the valve body 49 moves in the downward direction by the urging force of the valve spring 52, so that the auxiliary fuel passage 47 is opened.

To summarize, the auxiliary fuel passage 47 communicating between the fixed venturi portion 6 and a space formed between two nozzles 36 and 38 is opened or closed on the basis of the vacuum generated within the intake passage 1, that is, engine operating conditions.

On the other hand, a tapered jet needle 28 fixed to the bottom portion of the suction piston 24 is loosely fitted in the first and second nozzles 36 and 38. A first annular metering portion 62 is formed between the tapered jet needle 28 and the first nozzle 36; a second annular metering portion 63 is formed between the tapered jet needle 28 and the second nozzle 38. The diameter of the second nozzle 38 is generally greater than that of the first nozzle 36 and therefore the metering jet area of the second metering jet portion 63 is greater than that of the first metering portion 62. When the suction piston 24 moves up and down, since the jet needle 28 also moves up and down, the areas of these first and second metering jet portions 62 and 63 also change. In more detail, when the jet needle 28 moves in the upward direction, these metering jet areas increase.

Further, in FIG. 3, the reference numeral 59 denotes an idle adjusting bolt for adjusting the height of the nozzle body 39 in order to predetermine an appropriate air-to-fuel ratio when an engine is being idled.

The operation of the first embodiment of the variable venturi carburetor according to the present invention will be described hereinbelow. First, description is made of the fact that even when the amount of intake air is constant, the required air-to-fuel ratio varies according to engine operating conditions.

Figure 4:
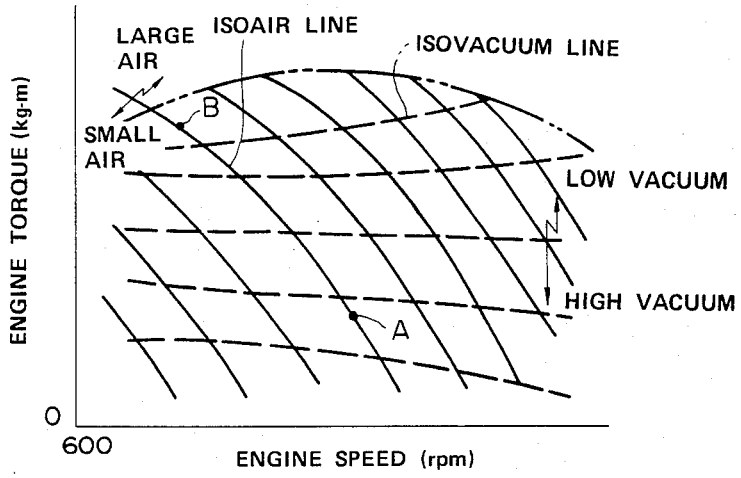
FIG. 4 is a graphical representation showing the relationship between engine speed and engine torque with the amount of intake air and the vacuum within intake pipe as parameters, respectively.

FIG. 4 is a graphical representation describing the relationship between engine speed (rpm) and engine torque (kg-m) with the amount of intake air and the vacuum generated downstream of the throttle valve within the intake pipe as parameters. This graphical representation indicates that when the amount of intake air is constant, engine torque is roughly inversely proportional to engine speed, as depicted by solid lines (isoair lines), and that when the vacuum generated downstream of the throttle valve is constant, engine torque is roughly constant irrespective of engine speed, as depicted by dashed lines (isovacuum lines).

If the amount of intake air is constant, when engine is driven at a relatively high speed and under a relatively low engine torque as shown by point A in FIG. 4, a lean mixture (e.g. economy-oriented air-to-fuel ratio of about 18) is required from an economical standpoint; and when engine is driven at a relatively low speed and under a relatively high torque as shown by point B in FIG. 4, a rich mixture (e.g. torque-oriented air-to-fuel ratio of about 11.5) is required for increasing engine power.

Figure 5:
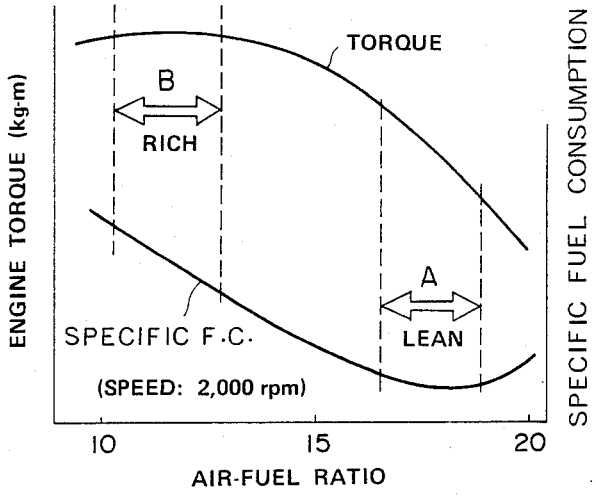
FIG. 5 is a graphical representation showing the relationship between air-to-fuel ratio and engine torque and the relationship between air-to-fuel ratio and specific fuel consumption rate.

In this embodiment, when the engine is running under operating conditions as shown by point A in FIG. 4 (high speed, low torque, high vacuum), since the control valve 48 closes the auxiliary fuel passage 47, a lean mixture can be obtained. In contrast with this, when the engine is running under operating conditions as shown by point B in FIG. 4 (low speed, high torque, low vacuum), since the control valve 48 opens the auxiliary fuel passage 47, a rich mixture can be obtained. In summary, the air-to-fuel ratio can be varied according to engine operating conditions by opening or closing the auxiliary fuel passage in response to vacuum generated downstream of the throttle valve within the intake passage. Further, FIG. 5 is a graphical representation describing the relationship between air-to-fuel ratio and engine torque and the relationship between air-to-fuel ratio and specific fuel consumption rate obtained when engine speed is about 2,000 rpm, in which labels A and B denote a lean mixture region and a rich mixture region corresponding to the points A and B shown in FIG. 4, respectively. Further, the greater the air-to-fuel ratio, the leaner the mixture, or the smaller the air-to-fuel ratio, the richer the mixture.

In the above description, an economy-oriented lean mixture is determined to be about 18 air-to-fuel ratio and a torque-oriented rich mixture is determined to be about 11.5 in air-to-fuel ratio, by way of example. Therefore, the method of determining two appropriate air-to-fuel ratios will be described hereinbelow with reference to FIGS. 6 and 7.

In the following expressions, the label $A_1$ denotes the cross-sectional area of this first metering jet portion 62, the label $C_1$ denotes the coefficient of fuel discharge from this first metering jet portion 62, the label $P_3$ denotes the pressure on the downstream side from the first metering jet portion 62 (equal to the vacuum at the venturi portion); further, the label $A_2$ denotes the cross-sectional area of this second metering jet portion 63, the label $C_2$ denotes the coefficient of fuel discharge from the second metering jet portion 63, the label $P_1$ denotes the pressure on the upstream side from the second metering jet portion 63 (equal to the pressure within the nozzle body 39). The discharge $Q_A$ jetted through the first and second metering jet portions 62 and 63 to the intake passage 1 when the control valve 48 closes the auxiliary fuel passage 47 can be expressed as follows:

$$Q_A = C_1A_1\sqrt{\frac{2g}{v}\cdot\frac{1}{1+x^2}\cdot(P_1-P_3)} \quad (1)$$

The discharge $Q_B$ jetted through only the second metering jet portion 63 to the intake passage 1 when the control valve 48 opens the auxiliary fuel passage 47 can be expressed as follows:

$$Q_B = C_2A_2\sqrt{\frac{2g}{v}\cdot(P_1-P_3)} \quad (2)$$

where g is acceleration due to gravity, and v is the specific volume of fuel. Further, the ratio of effective passage areas x is given as $$x = C_1A_1/C_2A_2 \quad (3)$$

In the case when the control valve 48 closes the auxiliary fuel passage 47, the discharge $Q_A$ undergoes the influence of the first and second metering jet portions 62 and 63, as clearly understood by expressions (1) and (3). On the other hand, in the case when the control valve 48 opens the auxiliary fuel passage 47, the discharge $Q_B$ undergoes the influence of only the second metering jet portion 63, as understood by expression (2).

Therefore, the ratio of two discharges can be expressed as $$Q_B/Q_A = \sqrt{\frac{1+X^2}{X^2}} \quad (4)$$

This indicates that since X is generally smaller than one ($A_1$ is smaller than $A_2$), $Q_B$ obtained when the auxiliary fuel passage 47 is open is generally greater than $Q_A$ obtained when the passage 47 is closed. In other words, it is possible to increase the fuel discharge when the vacuum within the intake passage is low, that is, engine speed is low.

Figure 6:
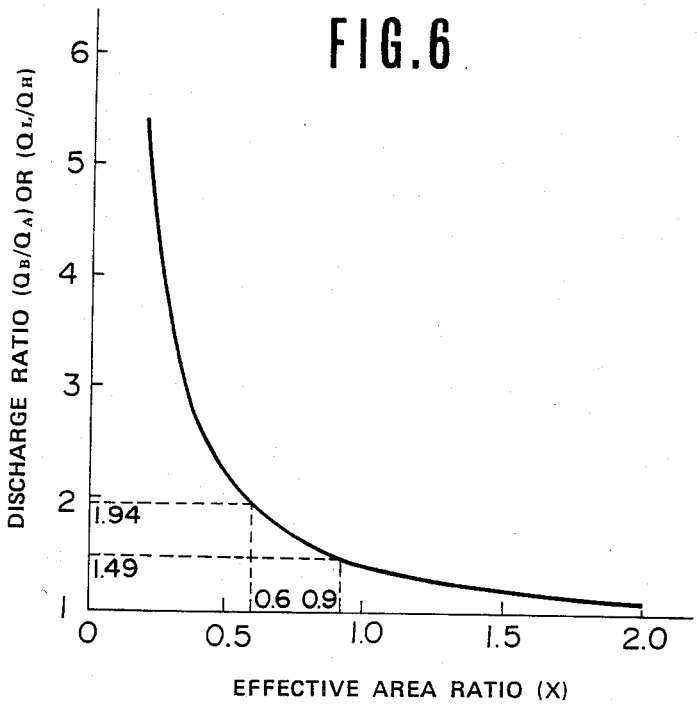
FIG. 6 is a graphical representation showing the relationship between the effective area ratio X of two nozzle portions and the ratio of fuel discharge $Q_B$ ($Q_L$) passed through the second nozzle and the auxiliary fuel passage to fuel discharge $Q_A$ ($Q_H$) passed through only the first nozzle.
Figure 7:
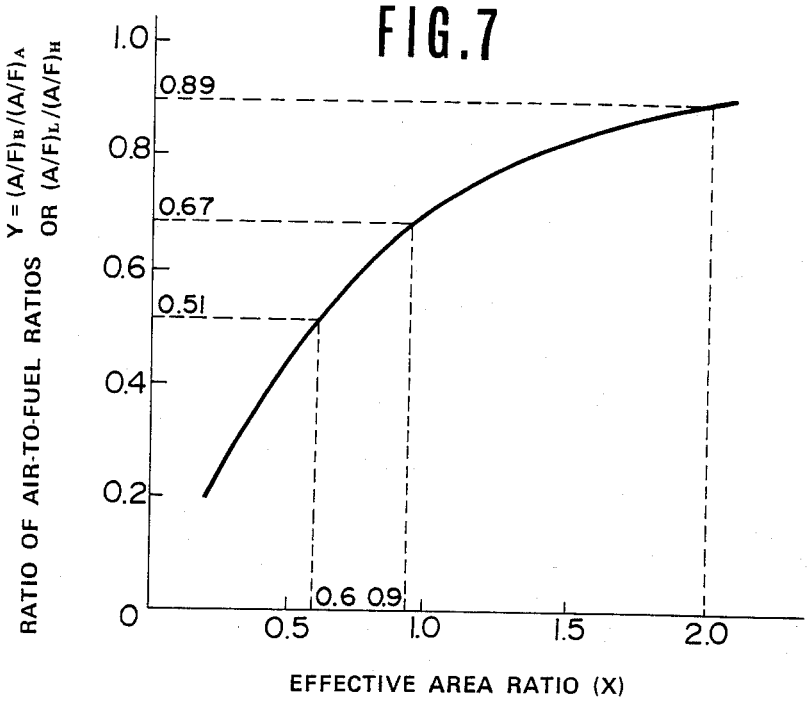
FIG. 7 is a graphical representation showing the relationship between the effective area ratio X of two nozzle portions and the ratio Y of air-to-fuel ratio $(A/F)_B$ or $(A/F)_L$ passed through the second nozzle and the auxiliary fuel passage to air-to-fuel ratio $(A/F)_A$ or $(A/F)_H$ passed through only the first nozzle.

FIG. 6 is a graphical representation describing the relationship between X (effective passage area ratio) and $Q_B/Q_A$ (discharge ratio) obtained on the basis of expression (4). Further, FIG. 7 is a graphical representation describing the relationship between X (effective passage area ratio) and $Y=(A/F)_B/(A/F)_A$ (ratio of air-to-fuel ratio in discharge $Q_B$ to that in discharge $Q_A$).

Accordingly, for instance, if the ratio of effective passage areas X is 0.9, the ratio of discharges $Q_B/Q_A$ is 1.49 on the basis of expression (4) or as shown in FIG. 6. Further, under this condition (X=0.9), in the case where the air-to-fuel ratio $(A/F)_A$ in fuel discharge $Q_A$ is set to 18, since the ratio of air-to-fuel ratio Y is 0.67 as depicted in FIG. 7, the air-to-fuel ratio in fuel discharge $Q_B$ is 12.1 ($=18\times0.67$).

As described above by predetermining the ratio X of effective passage area of the first nozzle 36 to that of the second nozzle 38 at an appropriate value, it is possible to obtain both economy-oriented air-to-fuel ratio and power-oriented air-to-fuel ratio in the same amount of intake air. In the above-mentioned example, since X is 0.9, if the air-to-fuel ratio at point A (high speed, low torque, high vacuum) is predetermined to be 18 (lean mixture as shown within A in FIG. 5), the air-to-fuel ratio at point B (low speed, high torque, low vacuum) is 12.1 (rich mixture as shown within B in FIG. 5).

In the variable-venturi carburetor as described above, since a rich mixture can be obtained by opening the auxiliary fuel passage when intake vacuum is low, it is possible to utilize these fuel-enriching functions for increasing engine power reliably or for starting a cool engine securely.

Figure 8:
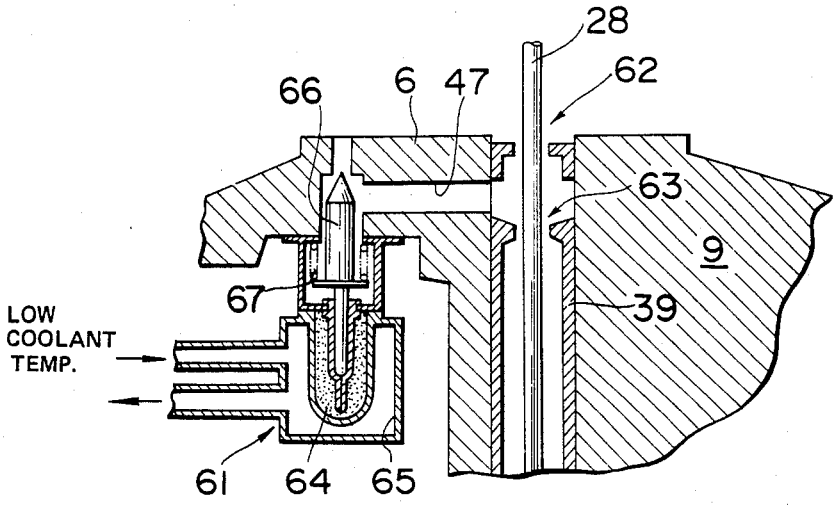
FIG. 8 is an enlarged cross-sectional view of a second embodiment of the variable venturi carburetor according to the present invention showing the fixed venturi portion including two series-arranged nozzle portions, auxiliary fuel passage, and a control valve having a thermowax and a coolant chamber.
Figure 9:
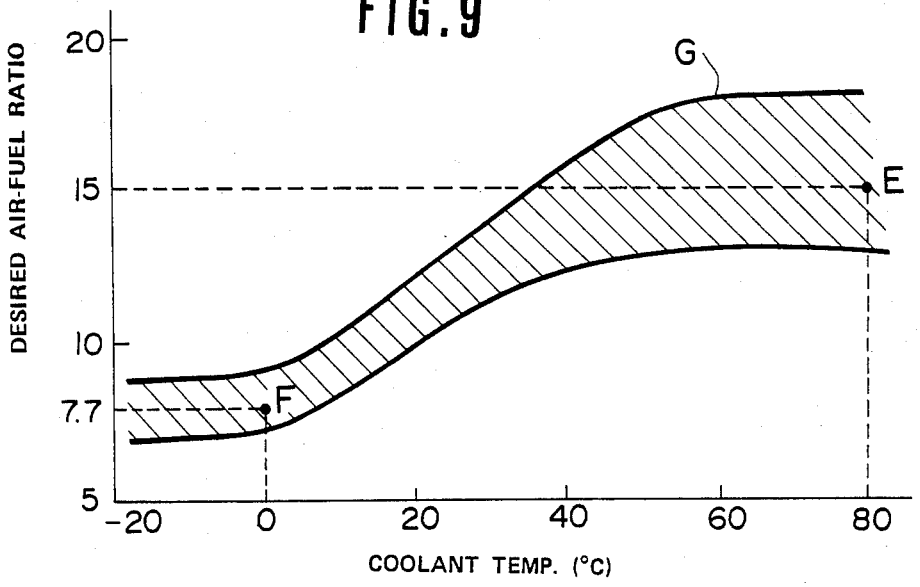
FIG. 9 is a graphical representation showing the relationship between engine coolant temperature and preferable air-to-fuel ratio.

FIG. 8 shows a second embodiment of the variable venturi carburetor according to the present invention. The feature of this embodiment is to open the auxiliary fuel passage 47 for obtaining a rich mixture when engine coolant temperature is low and to close the auxiliary fuel passage 47 for obtaining a lean mixture when engine coolant temperature is high. This is because it is preferable to change air-to-fuel ratio according to engine coolant temperature, as depicted in FIG. 9.

In FIG. 8, a control valve 61 including thermowax is provided to open or close the area of the auxiliary fuel passage 47, in place of the control valve 48 shown in FIG. 3. In more detail, the control valve 61 comprises a valve body 66, a spring 67 for urging the valve body 66 in the direction that the auxiliary fuel passage 47 is open, a thermowax 64, and a coolant chamber 65 through which engine coolant is circulated. The volume of the thermowax 64 expands when heated, but shrinks when cooled.

Therefore, in the case where engine coolant temperature is low, since the thermowax 64 shrinks, the valve body 66 is moved by the spring 67 in the direction that the auxiliary fuel passage 47 is open, so that a rich mixture can be obtained. In contrast with this, in the case where engine coolant temperature is high, since the thermowax 64 expands, the valve body 66 is moved against the urging force of the spring 67 in the direction that the auxiliary fuel passage 47 is closed, so that a lean mixture can be obtained. In summary, the variable venturi carburetor according to this embodiment can always supply a mixture with preferable air-to-fuel ratio to the engine according to engine warm-up conditions.

As already described, the discharge $Q_H$ jetted through the first and second metering jet portions 62 and 63 to the intake passage 1 when coolant temperature is high and therefore the control valve 61 closes the auxiliary fuel passage 47 is equal to the discharge $Q_A$ given by expression (1).

The discharge $Q_L$ jetted through only the second metering jet portion 63 to the intake passage 1 when coolant temperature is low and therefore the control valve 61 opens the auxiliary fuel passage 47 is equal to the discharge $Q_B$ given by expression (2). Further, the ratio of two discharges can similarly be expressed as $$Q_L/Q_H = \sqrt{\frac{1+X^2}{X^2}}$$

Therefore, it is possible to increase the fuel discharge when coolant temperature is low.

Further, while the engine is being warmed up, it is also possible to decrease the fuel discharge gradually from $Q_L$ to $Q_H$ by gradually closing the auxiliary fuel passage 47. For instance, if the air-to-fuel ratio required after the engine has been warmed up to about 80° C. is determined to be about 15 as shown by point E in FIG. 9 and the air-to-fuel ratio required before the engine is warmed up from about 0° C. is about 7.7 as shown by point F in FIG. 9, the ratio of effective passage areas X should be determined to be 0.6. This is because if X is 0.6, the ratio of air-to-fuel ratios $Y=(A/F)_L/(A/F)_H=7.7/15$ is 0.51 as depicted in FIG. 7. Further, as depicted in FIG. 6, the discharge ratio $Q_L/Q_H$ is 1.94 if X=0.6.

Further, when the shinkage rate of the thermowax 64 is so designed that the passage area of the auxiliary fuel passage 47, that is, the air-to-fuel ratio can be controlled within a range G shown by a shaded portion in FIG. 9 according to the change in coolant temperature while the engine is warmed up, it is possible to eliminate a choke valve which will cause an increase in pressure loss within the intake pipe where disposed. In other words, it is possible to obtain desired various air-to-fuel ratios efficiently without any pressure loss or intake air loss within the intake pipe.

Figure 10:
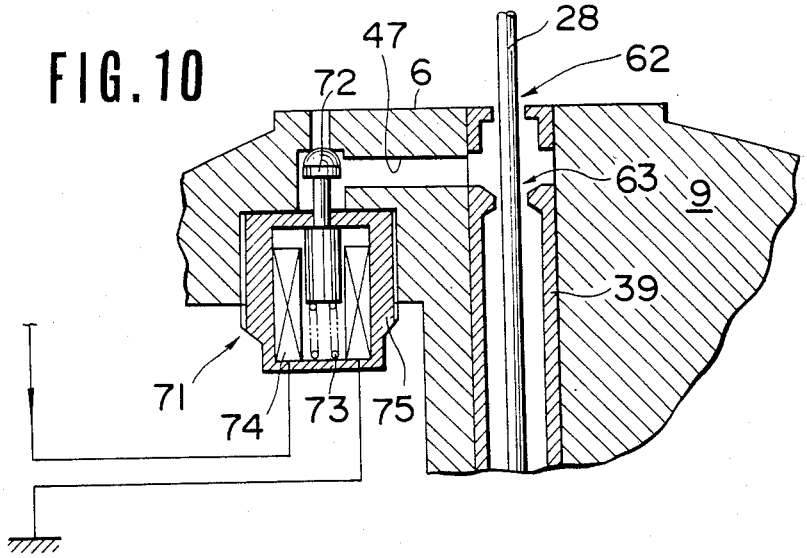
FIG. 10 is an enlarged cross-sectional view of a third embodiment of the variable venturi carburetor according to the present invention showing the fixed venturi portion including two series-arranged nozzle portions, an auxiliary fuel passage, and an electromagnetic control valve.
Figure 11:
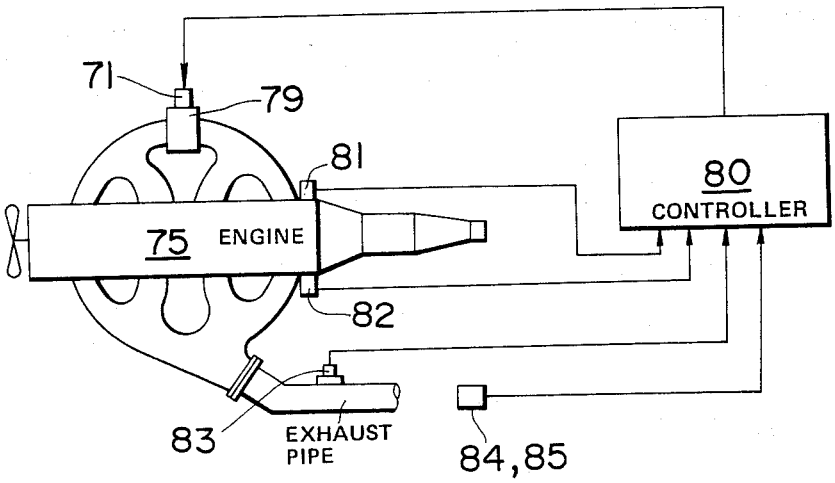
FIG. 11 is a schematic block diagram showing the third embodiment shown in FIG. 10, in which the variable venturi carburetor according to the present invention is shown as a system including an engine, an exhaust pipe, a controller, and various engine operating condition sensors.

FIGS. 10 and 11 show a third embodiment of the variable venturi carburetor according to the present invention. The feature of this embodiment is to open or close the auxiliary fuel passage 47 for obtaining a mixture with an appropriate air-to-fuel ratio according to various engine operating conditions, synthetically.

Figure 12:
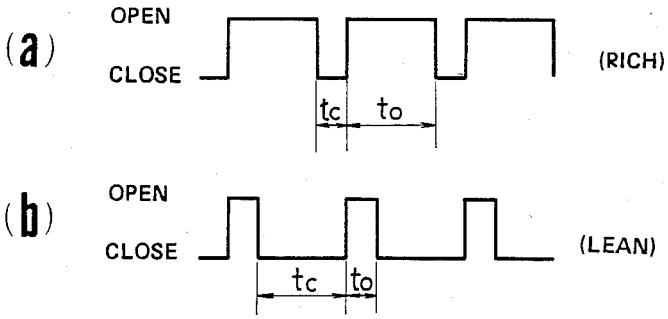
FIG. 12(*a*) is a graphical representation showing a control signal of a great duty cycle outputted from the controller shown in FIG. 11.

Similarly to the first and second embodiments shown in FIGS. 3 and 8, an electromagnetic control valve 71 is disposed for opening or closing the auxiliary fuel passage 47. The valve 71 is made up of a valve housing 75, a valve body 72, a spring 73 for urging the valve body 72 in the direction that the auxiliary fuel passage 47 is closed, and a solenoid 74 for retracting, when energized, the valve body 72 in the direction that the auxiliary fuel passage 47 is opened. To energize the control valve 71, a controller 80 such as a microcomputer is provided. To this controller 80, various signals indicative of engine operating conditions are inputted from various sensors such as an engine combustion pressure sensor 81, an engine coolant temperature sensor 82, an exhaust gas oxygen sensor 83, an engine speed sensor 84, an engine vibration sensor 85, etc. In response to these signals, the controller 80 determines an appropriate air-to-fuel ratio in accordance with table look-up method, and outputs a control signal to the solenoid 74. The control signal is a pulse signal of a constant frequency, the duty cycle of which is controlled by the controller 80. In more detail, when a rich mixture is required, the time interval $t_o$ during which the control valve 71 is being energized is determined to be longer than that $t_c$ during which the control valve 71 is being deenergized, as depicted in FIG. 12(*a*), in order to open the auxiliary fuel passage 47 for a longer time period. On the other hand, when a lean mixture is required, the time interval $t_o$ during which the control valve 71 is being energized is determined to be shorter than that $t_c$ during which the control valve 71 is being deenergized, as depicted in FIG. 12(*b*).

Therefore, the greater the duty cycle $(t_o/t_o+t_c)$ or the longer the ON time interval $t_o$, the longer the energization time interval of the control valve 71 and therefore the richer the air-to-fuel mixture. In this embodiment, it is possible to control the air-to-fuel ratio according to various engine operating conditions, simultaneously and synthetically.

With reference to FIGS. 6 and 7 again, if the air-to-fuel ratio $(A/F)_{ON}$ (rich) obtained when the electromagnetic control valve 71 is energized is determined to be 13.9 and the ratio of the effective areas $X=C_1A_1/C_2A_2$ is determined to be 2, for instance, a ratio of air-to-fuel ratio $Y=(A/F)_{ON}/(A/F)_{OFF}$ is 0.89 as shown in FIG. 7. Therefore, the air-to-fuel ratio $(A/F)_{OFF}$ (lean) obtained when the control valve 71 is deenergized is determined as 13.9/0.89=15.6. In this case, the discharge ratio $Q_{ON}/Q_{OFF}$ is near one, as depicted in FIG. 6.

In the above embodiments, an electromagnetic control valve 71 is used. However, it is also possible to incorporate a variable orifice combined by a taper needle and an orifice.

Figure 13:
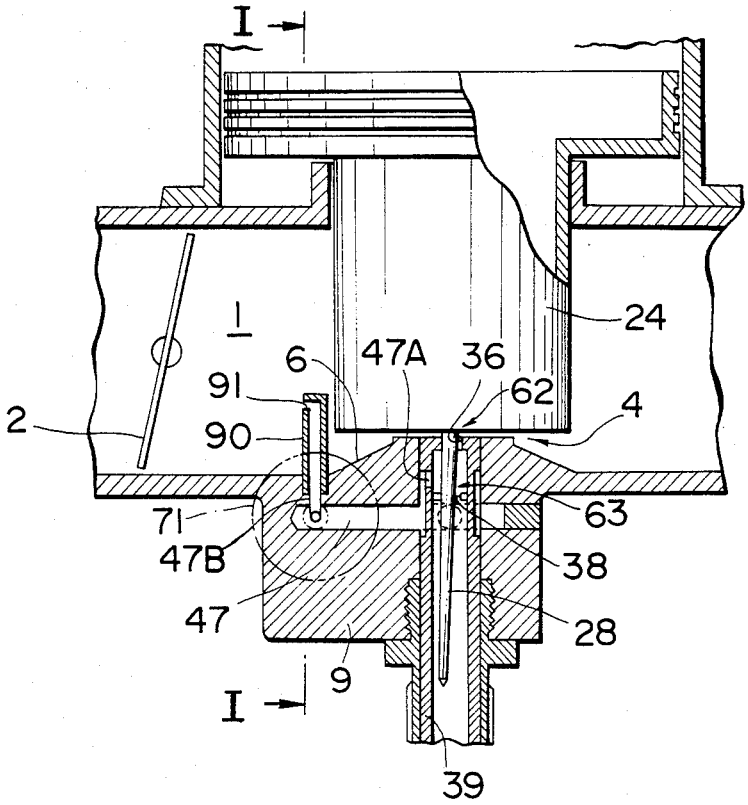
FIG. 13 is an enlarged cross-sectional side view showing a fourth embodiment of the variable venturi carburetor according to the present invention, in which a fuel cylinder is fitted to the auxiliary fuel passage, in particular.
Figure 14:
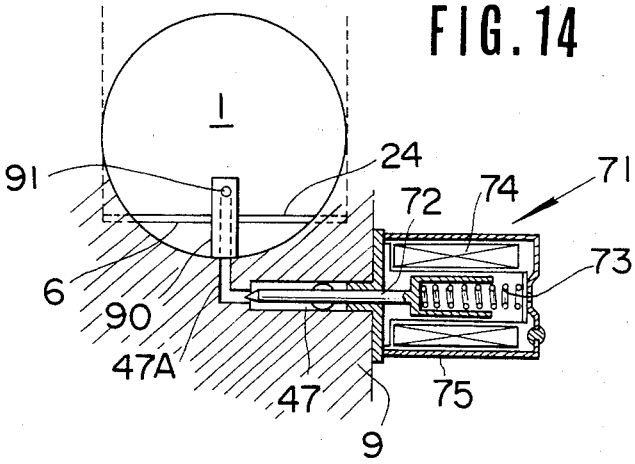
FIG. 14 is an enlarged cross-sectional front view of the fourth embodiment shown in FIG. 13.

FIGS. 13 and 14 show a fourth embodiment of the variable venturi carburetor according to the present invention. The feature of this invention is to provide a fuel cylinder 91 at the opening end of the auxiliary fuel passage 47 for atomizing rich mixture more securely.

As already described, since the jet needle 28 is formed in a tapered shape, if the diameter of the first nozzle portion 36 is equal to that of the second nozzle portion 38, the metering area of the second metering jet portion 63 is greater than that of the first metering jet portion 62. Therefore, when the auxiliary fuel passage 47 is opened under heavy engine load to supply a rich mixture, a relatively great amount of fuel is jetted into the intake passage 1 through the first nozzle portion 36 and the auxiliary fuel passage 47 (the second nozzle portion 38), as compared when fuel is jetted into the intake passage through only the first nozzle portion 36. In the case where the amount of fuel jetted into the intake passage 1 is excessively great, fuel tends to stick onto the inner wall of the intake pipe 9 and flows along the inner wall without being atomized perfectly. This imperfect atomization of fuel may cause some difficulties as follows: When the engine is required to be accelerated quickly, fuel is not supplied to the engine, thus lowering acceleration response speed. Further, when fuel atomization is imperfect, a mixture of the same air-to-fuel ratio is not supplied to each cylinder uniformly, thus exhausting harmful substances or unbalancing the torques generated by each engine cylinder. To overcome the above-mentioned problems, in this fourth embodiment, fuel supplied through the auxiliary passage 47 is jetted at a position where the speed of intake air is roughly the maximum or at the middle of the venturi portion, so that the fuel is well atomized by high-speed intake air.

In FIGS. 13 and 14, an auxiliary fuel passage 47 is formed in the fixed venturi portion 6, one end portion of which communicates with the intake air passage at a position between the throttle valve 2 and the jet needle 28 and the other end portion of which communicates with the nozzle body 39 through a hole 47A at a position between the first and second nozzles 36 and 38. A fuel cylinder 90 with a jet aperture 91 at top thereof is fitted to the vertical portion 47B of the auxiliary fuel passage 47. The fuel cylinder 90 is positioned on the downstream side from the venturi portion 4 adjacent to the suction piston 24. The jet aperture 91 is so positioned as to open toward the throttle valve 2 (toward the downstream side within the intake pipe 9) and as to be near the highest-speed portion of intake air flow. When the engine is driven under a heavy load, since the suction piston 24 moves in the upward direction, it is preferable to position this jet aperture 91 at or near the middle portion of the venturi formed between the fixed venturi portion 6 and the movable venturi portion 24 when the suction piston 24 moves to its uppermost position.

Further, in FIGS. 13 and 14, and electromagnetic control valve 71 is disposed horizontally perpendicular to the intake passage 9, being different from the third embodiment shown in FIG. 10 in which the control valve 71 is disposed vertically. In FIG. 13, the fuel cylinder 90 is disposed on the downstream side from the suction piston 24. However, it is of course possible to implant the fuel cylinder 90 in the fixed venturi portion 6 adjacent to the nozzle body 39.

In the structure as described above, when the engine load is light, since the auxiliary fuel passage is closed, fuel is jetted to the venturi portion 4 only through the first nozzle 36 and well mixed with the air passing through the narrow venturi portion 4 at a high speed to produce a lean mixture. When the engine load is heavy, since the auxiliary fuel passage is opened, fuel jetted to the intake passage 1 through the auxiliary fuel passage 47 and the fuel cylinder 90 is well mixed with the air passing at or near the middle (highest-speed) portion of the wide venturi portion 4 at the maximum high speed to produce a rich mixture. At the middle portion of the wide venturi 4, since the speed of air is sufficiently stable, fuel is effectively atomized even when the amount of jetted fuel is great.

Figure 15:
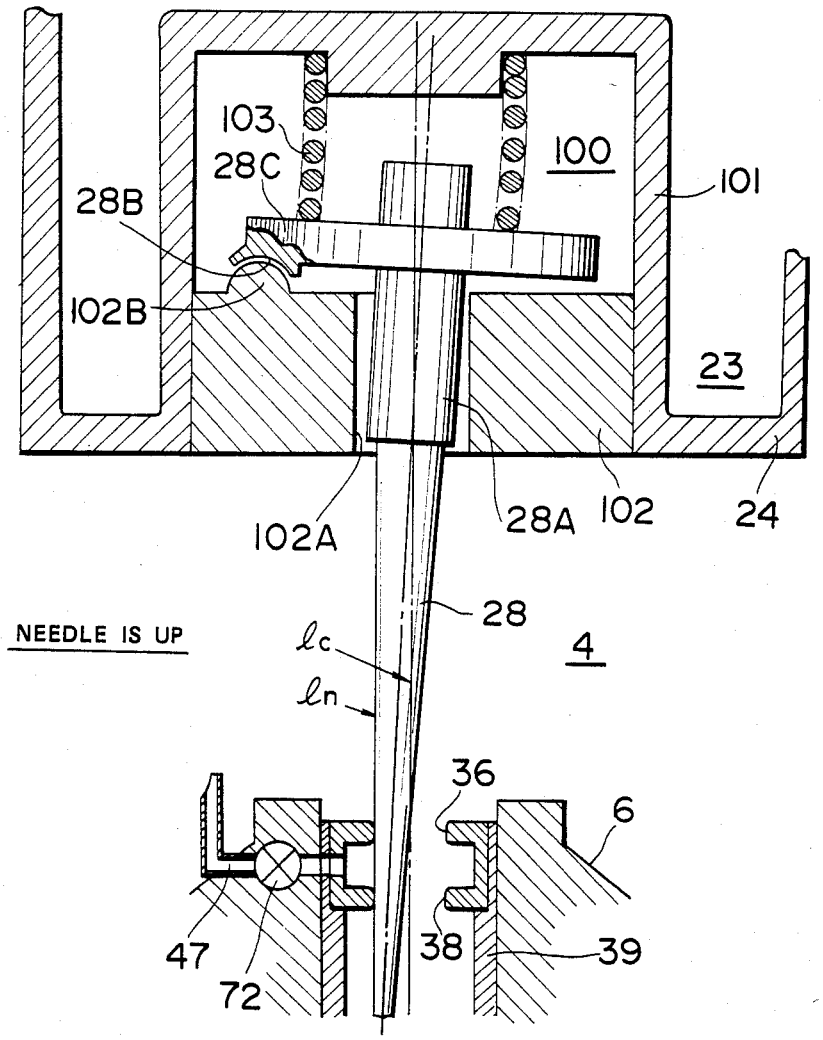
FIG. 15 is a further enlarged cross-sectional side view showing a sixth embodiment of the variable venturi carburetor according to the present invention, in which a tapered jet needle is pivotably supported within a jet needle holding chamber formed at the bottom of a suction piston, this drawing illustrating the state where the jet needle is moved to nearly the highest position.
Figure 16:
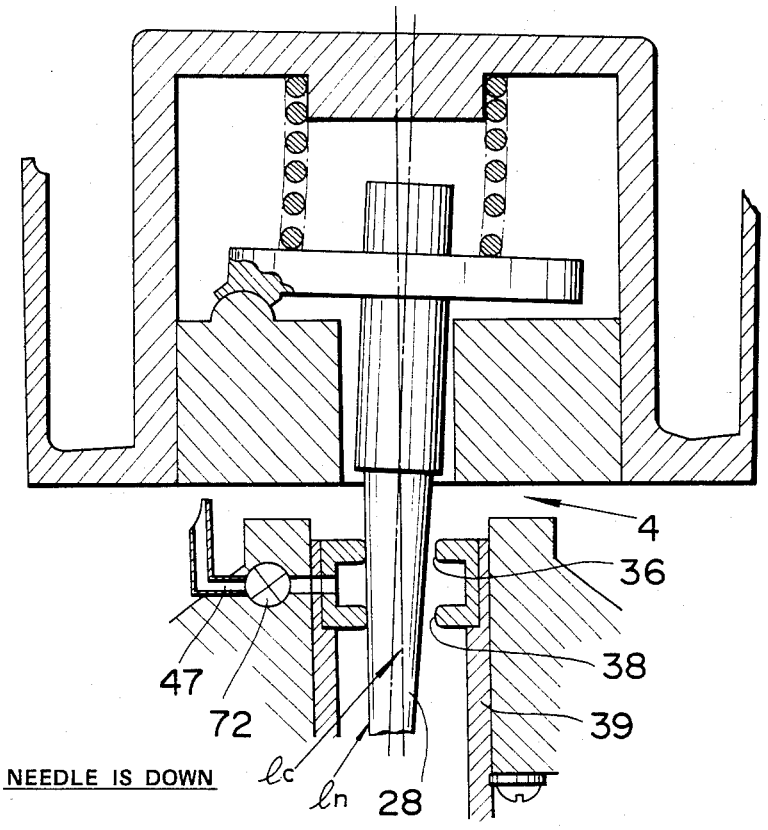
FIG. 16 is a similar enlarged cross-sectional side view as in FIG. 15, this drawing illustrating the state where the jet needle is moved to nearly the lowest position.

FIGS. 15 and 16 show a fifth embodiment of the variable venturi carburetor according to the present invention, in which the tapered jet needle 28 is so pivotably disposed obliquely with respect to the central axis of the nozzle body 39 as to be in contact with the first (upper) and second (lower) nozzle portions 36 and 38, respectively whenever the suction piston 24 moves up and down. Further, FIG. 15 shows the mutual relationship between the tapered jet needle 28 and the two nozzle portions 36 and 38 when the suction piston 24 is moved to its uppermost position and FIG. 16 shows the same mutual relationship when the suction piston 24 is moved to its lowermost position.

As already described, in the first to fourth embodiments of the variable venturi carburetor according to the present invention shown in FIGS. 3, 8, 10 and 13, a plurality of nozzles are provided. Therefore, the amount of fuel passed through the carburetor provided with these two nozzles is reduced as compared with that passed through the carburetor provided with a single nozzle, even if the diameter of two nozzles is equal to that of a single nozzle. The greater the diameter of the nozzle portion, the more accurate the amount of fuel passed through the nozzle. This is because it is possible to correlatively reduce the influence of manufacturing precision upon the diameter of the nozzle.

However, in the variable venturi carburetor of multi-nozzle type, the amount of fuel passed through the nozzle portions undergoes a serious influence of the precision of alignment of the tapered jet needle within the nozzle body, that is, the concentricity of the tapered jet needle to the nozzle portion. Once the alignment of these two elements is destroyed, the amount of fuel passed through between these two elements changes markedly. This is because the coefficient of discharge changes according to the eccentricity of these two elements, in spite of the fact that the metering jet area is the same. Therefore, unless the tapered jet needle is moved up and down at the center of the nozzle accurately, it is of course impossible to control the air-to-fuel ratio accurately through the metering jet portions.

Further, the influence of the above-mentioned misalignment of these two elements upon the accuracy of the amount of fuel to be jetted is serious in the first (upper) nozzle 36, since the jet needle is tapered and therefore the cross-sectional area formed between the needle and the first nozzle 36 is smaller than that formed between the needle and the second nozzle 38.

In FIGS. 15 and 16, at the bottom portion of the suction piston 24, a needle holding chamber 100 is formed being partitioned by a cylindrical wall 101 from the vacuum chamber 23 also formed within the suction piston 24. A tapered jet needle 28 is pivotably supported within the needle holding chamber 100 by an annular needle holding member 102 fixedly fitted to the needle holding chamber 100 from the side of the venturi portion 4. The needle holding member 102 is formed with a central hole 102A through which the base portion 28A of the jet needle 28 is loosely fitted. Therefore, the diameter of the central hole 102A of the needle holding member 102 is greater than that of the base portion 28A of the jet needle 28. Further, a semispherical convex jet needle supporting portion 102B is provided on the upper end surface of the member 102 and on the downstream side from the central hole 102A (on the throttle valve side) and a semispherical concave jet needle supporting portion 28B is provided on the outer bottom surface of a jet needle flange portion 28C formed integrally with the jet needle 28, in such a way as to mate with the convex portion 102A. A jet needle spring 103 is disposed in compression mode between the inner side of the cylindrical wall 101 of the suction piston 24 and the flange portion 28C of the jet needle 28. Therefore, the jet needle 28 is urged by the elastic force of the jet needle spring 103 toward the venturi side vertically and simultaneously toward the downstream side horizontally within the nozzle body 39, with the contact portion of two convex and concave needle supporting portions 102B and 28B as a fulcrum. Therefore, the outer surface of the jet needle 28 is brought into contact with the inner surface of the first and seond nozzle portion 36 or 38. In this case, it is preferable to bring the tapered jet needle 28 in contact with both the jet portions 36 and 38 simultaneously. For this purpose, the jet needle is supported obliquely within the needle holding chamber 100 by determining the mutual position or the dimensions of these two spherical portions 28B and 102B in such a way that the central working line **1*c* of the suction piston 24 is in parallel with the outer cylindrical sliding surface in of the tapered jet needle as depicted in FIG. 15. In such a structure as described above, since the tapered jet needle 28 moves up and down always in contact with the two nozzle portions 36 and 38, that is, since the mutual position relationship between the jet needle 28 and the two nozzles 36 and 38 is kept in a stable condition, the amount of fuel jetted through the nozzle portions does not fluctuate due to misalignment of the jet needle 28** within the nozzle portions 36 and 38 caused when the jet needle 28 moves up and down, thus stably controlling the air-to-fuel ratio.

Figure 17:
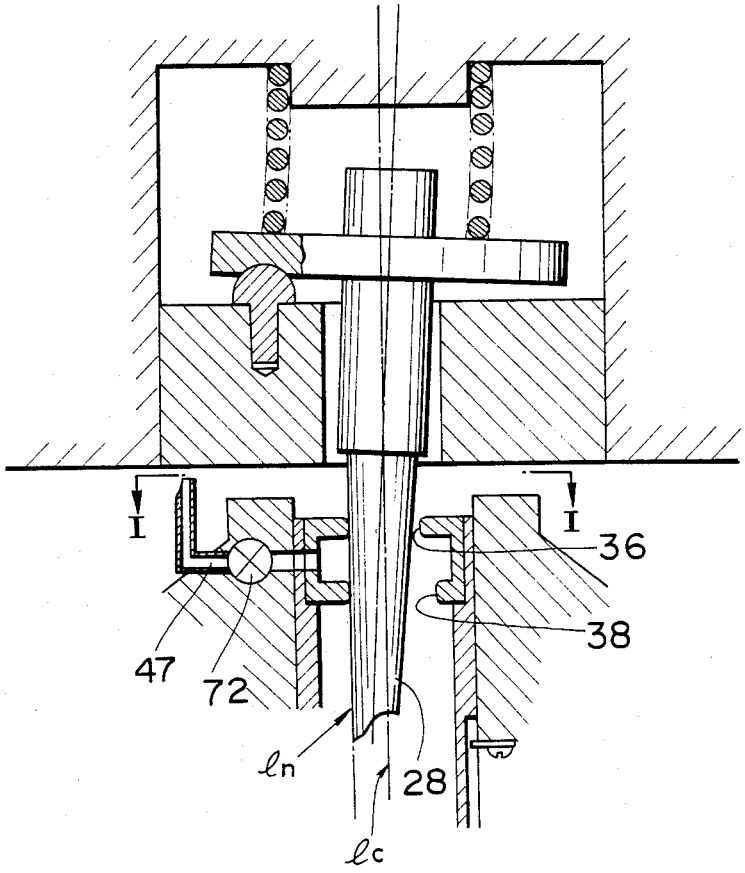
FIG. 17 is a similar enlarged cross-sectional side view as in FIG. 16, in which a nozzle body is formed with a first (upper) nozzle and a second (lower) nozzle the diameter of which is greater than that of the first nozzle.
Figure 18:
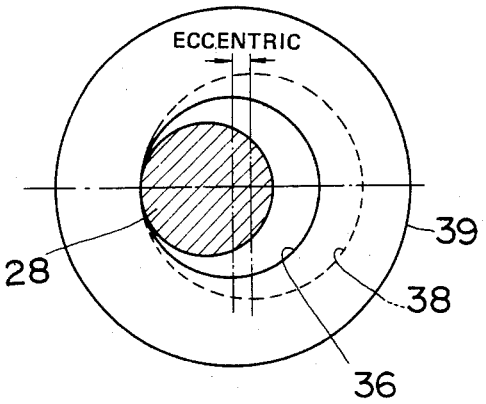
FIG. 18 is a top view showing only a tapered jet needle and first and second nozzles, in which two nozzles having different diameters are disposed eccentrically along the axis of the intake passage.

By the way, there exists a case where a very-lean mixture is required as compared with a rich mixture obtained when fuel is jetted through the auxiliary fuel passage 47. In such case, the diameter of the first (upper) nozzle 36 is determined to be fairly smaller than that of the second (lower) nozzle 38, as shown FIGS. 17 and 18. Under these conditions, the two centers of the first and second nozzles 36 and 38 are so arranged eccentrically, along the central axis of the intake passage, as depicted in FIG. 18, that the outer peripheral line in of the jet needle 28 in contact with both the inner surfaces of the two nozzle portions is in parallel with the central working axis of the suction piston 24.

Figure 19:
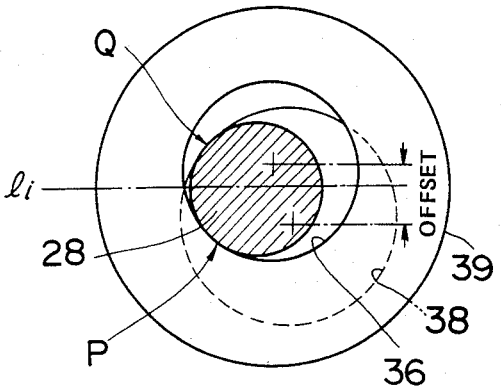
FIG. 19 is a similar top view, in which two nozzles are offset perpendicular to the axis of the intake passage.

Further, it is also preferable to offset these two nozzles perpendicularly to the central axis of the intake passage, irrespective of the fact that the diameters of two nozzle portions are equal to or different from each other, as depicted in FIG. 19. In FIG. 19, the center of the first nozzle portion 36 is offset to one side (upward) and that of the second nozzle portion 38 is offset to the other side (downward) from the central axis li of the intake passage 4. In this case, since the tapered jet needle 28 is in contact with the two nozzle portions 36 and 38 at points p and Q, respectively, it is possible to bring the tapered jet needle 28 in contract with the two nozzles more stably and simultaneously to reduce the abrasion caused by the friction generated between the needle 28 and the two inner surfaces of the nozzles 36 and 38.

Further, in the case where the outer surface of the jet needle 28 extends nonlinearly along the longitudinal direction thereof, for instance, quardratically, it is impossible to bring the jet needle 28 in contact with the inner surfaces of two nozzle portions 36 and 38 simultaneously. In such a case as described above, it is preferable to bring the jet needle 28 in contact with the inner surface of only the smaller-diameter nozzle portions (usually, the first or upper nozzle portion 36).

This is because when the fuel discharge (the amount of fuel to be jetted into the intake passage) is small, the influence of the change in eccentricity between the jet needle 28 and the nozzle 36 upon the change in fuel discharge is serious, as compared with the case where the fuel discharge is great. In other words, the greater the air-to-fuel ratio, the smaller the fuel discharge, accordingly, the greater the change in fuel discharge due to the change in the eccentricity. For this reason, it is desirable to bring the jet needle 28 in contact with the nozzle with a smaller metering jet area.

Figure 20:
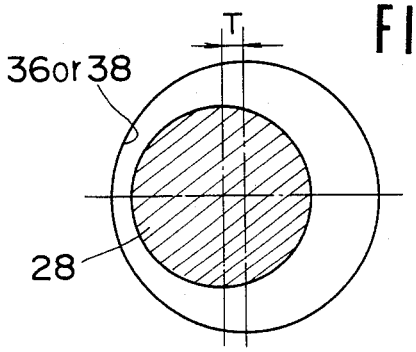
FIG. 20 is a top view showing the mutual relationship between the tapered jet needle and the nozzle.
Figure 21:
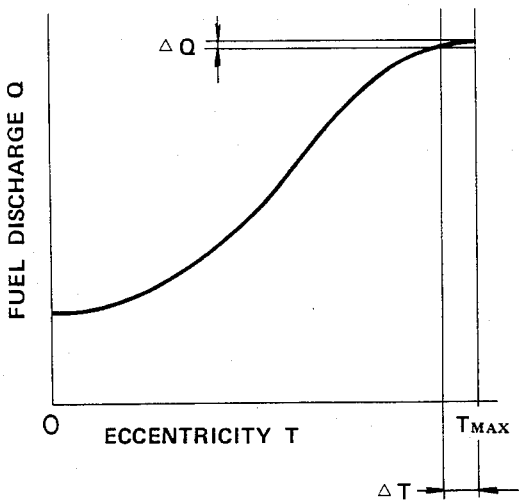
FIG. 21 is a graphical representation showing the relationship between the eccentricity of tapered jet needle and nozzle and the fuel discharge.

FIG. 20 shows the state where there exists an eccentricity T between the jet needle 28 and the nozzle 36 or 38 and FIG. 21 is a graphical representation showing the relationship between the eccentricity T and the fuel discharge Q through the eccentric metering jet portion. In FIG. 21, the label Tmax designates the eccentricity obtained when the needle is in contact with the nozzle and the label $\Delta T$ designate the displacement of the needle from the position of Tmax toward the center of the nozzle. This graphical representation indicates that the change $\Delta Q$ in fuel discharge Q is relatively small near the position of the maximum eccentricity Tmax.

In the above embodiment, the tapered jet needle 28 is pivotably and obliquely disposed within the two nozzles 36 and 38 in such a way that the outer surface of the needle is in contact with the inner surfaces of the nozzles on the downstream side of the nozzle portions. This is dependent upon the following reason. When the tapered jet needle 28 is obliquely disposed in such a way as to be in contact with the nozzles on the upstream side of the nozzle portions, the jet needle 28 vibrates by the pulsation of intake air. To overcome these vibrations, if the urging force of the jet needle spring 103 is increased, the contact pressure between the jet needle 28 and the nozzle portions 36 and 38 increases, so that the sliding resistance and thereby the abrasion may inevitably increase. In other words, it is possible to reduce the urging force of the needle spring 103, the sliding resistance and the abrasion between the needle 28 and the nozzles 36 and 38, by bringing the jet needle in contact with the nozzles on the downstream side.

The description has been made of the variable venturi carburetor provided with two nozzle portions, by way of example. However, it is of course possible to apply the present invention to the carburetor provided with three or more nozzle portions.

As described above, in the variable venturi carburetor according to the present invention, since at least two nozzles are provided in series and an auxiliary fuel passage communicating with the downstream side from the venturi and with the space formed between the two nozzles is formed at the fixed venturi portion in such a way that the auxiliary fuel passage can be opened or closed according to engine operating conditions, it is possible to supply a mixture of an appropriate air-to-fuel ratio to the engine under various engine operating conditions.

Further, since a fuel cylinder is additionally provided in such a way that fuel can be jetted into the intake passage at or near the highest-speed portion in the venturi, it is possible to atomize fuel sufficiently and stably.

Furthermore, since the tapered jet needle is pivotably supported by the suction piston in such a way that the outer surface of the needle is always in contact with the inner surfaces of the nozzles on the downstream side from the nozzle portion, it is possible to supply fuel into the venturi through the metering jet portion stably and accurately without fluctuation of fuel discharge therethrough when the jet needle is being moved up and down.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A variable venturi carburetor comprising:

(a) a fixed venturi portion;

(b) a nozzle body having at least two nozzle portions arranged in series, said nozzle body being disposed in said fixed venturi portion;

(c) a suction piston serving as a movable venturi portion for forming a venturi between said fixed venturi portion and said movable venturi portion within an intake passage, said suction piston movable toward or away from said fixed venturi portion in response to the vacuum generated due to air passing through the venturi, the movement of said suction piston varying the cross-sectional area of the venturi;

(d) a tapered jet needle attached to the lower end of said suction piston so as to pass through the nozzle portions formed in said nozzle body, said at least two nozzle portions and said tapered jet needle defining at least two nozzle passages adapted to convey fuel from a source to said venturi;

(e) an auxiliary fuel passage, one end of which communicates with the intake passage at a downstream region of said venturi and the other end of which communicates with a space formed between two adjacent nozzle portions; and (f) means for controlling the cross-sectional area of said auxiliary fuel passage according to engine operating conditions to supply, as required, a greater amount of fuel to the intake passage through at least one nozzle passage and said auxiliary fuel passage and a smaller amount of fuel to the intake passage through at least two nozzle passages.

2. A variable venturi carburetor as set forth in claim 1 wherein said controlling means comprises:

(a) a vacuum operated valve disposed at said auxiliary fuel passage; and (b) a vacuum passage, one end portion of which communicates with the intake passage on the downstream side from the venturi and the other end portion of which communicates with said vacuum operated valve, said vacuum operated valve decreasing the cross-sectional area of said auxiliary fuel passage with increasing vacuum generated within the intake passage and increasing the cross-sectional area of said auxiliary fuel passage with decreasing vacuum.

3. A variable venturi carburetor as set forth in claim 1 wherein said controlling means comprises:

(a) a control valve including:

(1) a valve body disposed at said auxiliary fuel passage for opening or closing same; and (2) a temperature responsive means for operating said valve body, said temperature responsive means being responsive to the temperature of engine coolant, and causing said valve body to close said auxiliary fuel passage when engine coolant temperature is high and causing said valve body to open said auxiliary fuel passage when engine coolant temperature is low.

4. A variable venturi carburetor as set forth in claim 1 wherein said control means comprises:

(a) an electrically operated valve for opening or closing said auxiliary fuel passage;

(b) a plurality of sensors for detecting engine operating conditions and outputting sensor signals corresponding thereto; and (c) a controller responsive to said sensors for outputting a control signal to said valve, the duty cycle of the control signal being determined in accordance with the sensor signals, for adjustably energizing said valve to open said auxiliary fuel passage, whereby the air-to-fuel ratio is controlled according to engine operating conditions.

5. A variable venturi carburetor as set forth in claim 4 wherein said sensors comprise at least one of an engine combustion pressure sensor, an engine coolant temperature sensor, an exhaust gas oxygen sensor, and an engine speed sensor.

6. A variable venturi carburetor as set forth in claim 1 which further comprises a fuel cylinder with a jet aperture opening toward the downstream side and within the intake passage, said fuel cylinder being in fluid communication with said auxiliary fuel passage and said jet aperture being positioned substantially near the middle portion of the venturi formed when said suction piston moves to the uppermost position.

7. A venturi carburetor as set forth in claim 1 wherein said tapered jet needle is pivotably supported by said suction piston in such a way that the outer tapered surface of said needle is always in contact with the inner surface of at least one of said at least two nozzle portions on the downstream side from the central axis of said nozzle body while said suction piston moves up and down within said nozzle body.

8. A venturi carburetor as set forth in claim 7 wherein said tapered jet needle pivotably supported by said suction piston is in contact with a nozzle having the smallest diameter of said at least two nozzle portions.

9. A venturi carburetor as set forth in claim 7 wherein said tapered jet needle pivotably supported by said suction piston is in contact with one of said at least two nozzle portions and the other of said at least two nozzle portions at a single contact point when the diameter of one of said nozzle portion is not equal to that of the other of said nozzle portion and said two nozzle portions are disposed eccentrically along the central axis of the intake passage.

10. A venturi carburetor as set forth in claim 7 wherein said tapered jet needle pivotably supported by said suction piston is in contact with one of said at least two nozzle portions and the other of said at least two nozzle portions at two contact points when said two nozzle portions are offset perpendicularly to the central axis of the intake passage.

11. A venturi carburetor as set forth in claim 1 wherein said end of said auxiliary fuel passage which communicates with said intake passage is located in said fixed venturi portion.

12. A venturi carburetor as set forth in claim 1 wherein said end of said auxiliary fuel passage which communicates with said intake passage is located contiguous to said fixed venturi portion.

13. A venturi carburetor as set forth in claim 1 wherein said end of said auxiliary fuel passage which communicates with said intake passage is located intermediate said jet needle and a throttle valve located downstream from said jet needle.

* * * * *